US008246210B2

(12) United States Patent
Angelini et al.

(10) Patent No.: US 8,246,210 B2
(45) Date of Patent: Aug. 21, 2012

(54) LIGHTING DEVICE WITH ADJUSTABLE LIGHT BEAM, PARTICULARLY FOR A FLASHLIGHT

(75) Inventors: Marco Angelini, Trivolzio (IT); Claudia Bigliati, Trino (IT)

(73) Assignee: Fraen Corporation S.R.L., Reading, MA (US)

( * ) Notice: Subject to any disclaimer, the term of this patent is extended or adjusted under 35 U.S.C. 154(b) by 0 days.

(21) Appl. No.: 13/054,296

(22) PCT Filed: Jul. 15, 2009

(86) PCT No.: PCT/IB2009/006243

§ 371 (c)(1),
(2), (4) Date: Jun. 1, 2011

(87) PCT Pub. No.: WO2010/007504

PCT Pub. Date: Jan. 21, 2010

(65) Prior Publication Data

US 2011/0267823 A1 Nov. 3, 2011

(30) Foreign Application Priority Data

Jul. 15, 2008 (IT) ..... MI2008A1287

(51) Int. Cl.
*F21V 14/08* (2006.01)
*F21V 13/12* (2006.01)
*F21V 14/06* (2006.01)

(52) U.S. Cl. ..... 362/279; 362/187; 362/268; 362/319; 362/331

(58) Field of Classification Search ..... 362/187, 362/268, 277, 291, 330, 331, 521, 539, 279, 362/319; 353/97; 359/621
See application file for complete search history.

(56) References Cited

U.S. PATENT DOCUMENTS 2,341,822 A * 2/1944 Seal ..... 362/202
3,522,424 A * 8/1970 Fritsch ..... 362/268

(Continued)

FOREIGN PATENT DOCUMENTS

WO 2004001287 12/2003

OTHER PUBLICATIONS

International Search Report, dated and mailed Dec. 17, 2009, from the European Patent Office, for International Application No. PCT/IB2009/006243.

*Primary Examiner* — Peggy A. Neils
(74) *Attorney, Agent, or Firm* — Nutter McClennen & Fish LLP; Reza Mollaaghababa

(57) ABSTRACT

An adjustable light beam lighting device, particularly for a flashlight, has in succession along an axis a light source, a collimator collimating the light into a collimated beam, and a first optical element and a second optical element provided with respective arrays of side-by-side lenses arranged according to a network pattern. The lenses of the first element face respective lenses of the second element and are shaped to, respectively, converge and diverge the light from the collimated beam. A mask between the elements is shaped to laterally screen the light exiting from each lens of the first element and to convey the light exiting from each lens of the first element only on the facing lens of the second element, thus screening the adjacent lenses. A movement mechanism translates the elements with along the axis to vary the width of the beam emitted by the device.

19 Claims, 3 Drawing Sheets

U.S. PATENT DOCUMENTS

| | | | | |
|---|---|---|---|---|
| 4,448,504 | A * | 5/1984 | Altman | 353/36 |
| 5,068,768 | A * | 11/1991 | Kobayashi | 362/539 |
| 5,504,831 | A * | 4/1996 | Sandhu et al. | 392/418 |
| 6,170,971 | B1 * | 1/2001 | Godbillon | 362/543 |
| 6,769,777 | B1 * | 8/2004 | Dubin et al. | 353/97 |
| 7,261,438 | B2 * | 8/2007 | Alessio | 362/268 |
| 8,096,661 | B2 * | 1/2012 | Arai | 353/20 |
| 2002/0118344 | A1 | 8/2002 | Fischer et al. | |
| 2003/0231490 | A1 | 12/2003 | Echterling | |

* cited by examiner

LIGHTING DEVICE WITH ADJUSTABLE LIGHT BEAM, PARTICULARLY FOR A FLASHLIGHT

This application is a U.S. National Stage under 35 U.S.C. §371 of International Application No. PCT/IB2009/006243, filed Jul. 15, 2009, which claims priority from Italian Patent Application No. MI2008A001287, filed Jul. 15, 2008.

TECHNICAL FIELD

The present invention relates to an adjustable light beam lighting device, particularly (but not only) adapted to be employed in a flashlight.

BACKGROUND ART

A flashlight provided with an adjustable light beam system is disclosed, for example, by WO2006072885. This system, like other similar systems, is not free from drawbacks, however, especially if used with LED light sources.

In fact, using central symmetry lenses (e.g. annular lenses arranged about the optical axis of the device, as shown indeed in WO2006072885) determines the formation of light rings, instead of a homogenous light beam.

Furthermore, satisfactory light beams are not generally obtained with the mentioned system (but also with other systems having different lens shape and geometry) for every beam opening condition, but only for specific beam conditions.

Finally, beams in which faults appear, in particular spots which reproduce the shape of the lenses used, are normally obtained.

DISCLOSURE OF INVENTION

It is thus an object of the present invention to provide an adjustable beam lighting device which is free from the drawbacks of the prior art described herein.

The present invention relates to an adjustable light beam lighting device, particularly for a flashlight, as defined in essential terms in the appended claim 1.

The device of the invention is a simple, effective system for adjusting the width of a light beam, while being very efficient, and which also allows to obtain entirely homogenous light beams, free from the faults commonly associated with the known solutions.

BRIEF DESCRIPTION OF THE DRAWINGS

Further features and advantages of the present invention will be apparent from the following description of a non-limitative embodiment thereof, with reference to the figures of the accompanying drawing, in which.

BEST MODE FOR CARRYING OUT THE INVENTION

Figure 1:
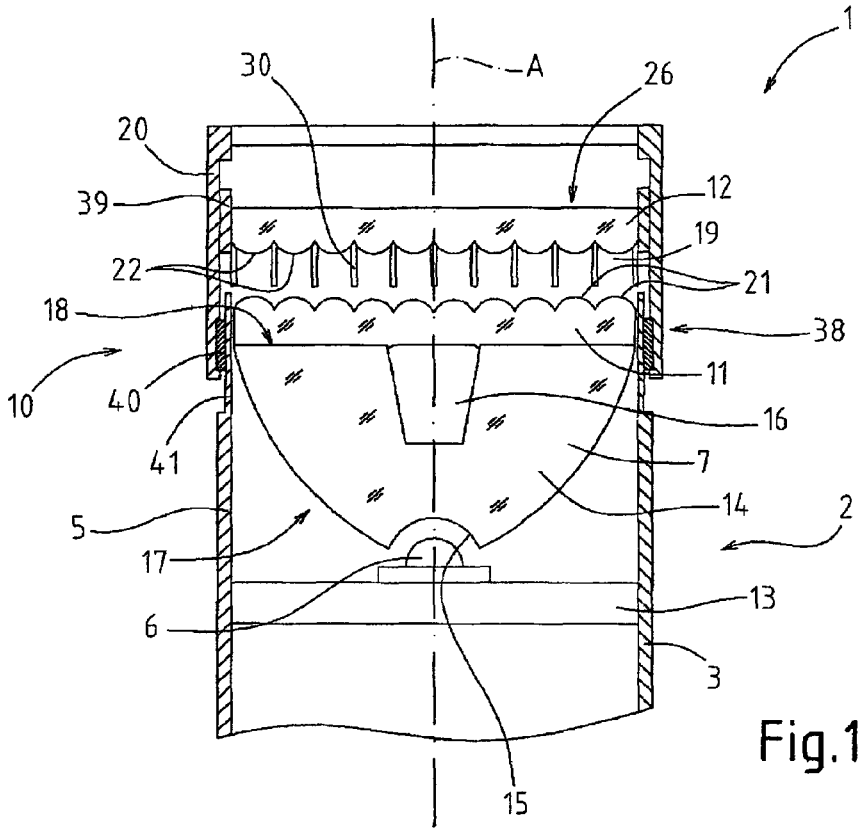
FIG. 1 is a diagrammatic, partial side elevation view, with parts in section, of an adjustable light beam lighting device in accordance with the invention, used in a flashlight by way of example only.

In FIG. 1, numeral 1 indicates as a whole an adjustable light beam lighting device, used for example in a flashlight 2; it is understood that the device 1 may be also applied to other types of lighting apparatuses.

The flashlight 2 comprises a tubular body 3 (only partially shown in FIG. 1) accommodating one or more batteries (not shown); an end portion of the body 3 forms a casing 5 for accommodating the device 1.

The device 1 substantially extends along an axis A and comprises in succession along axis A: a light source 6, a collimator 7 collimating the light emitted by the source 6 into a collimated beam, and a first optical element 11 and a second optical element 12 provided with respective arrays of lenses 21, 22; the device 1 further comprises a movement mechanism 10 capable of moving the elements 11, 12 with respect to each other by a movement of translation only along axis A, so as to vary the distance along axis A between the elements 11, 12 and therefore varying the width (i.e. the convergence-divergence) with respect to axis A of the light beam emitted by the device 1.

The source 6 is mounted to a fixed support 13 integral with the casing 5; in particular, the source 6 is a LED; obviously, although reference is hereinafter made to a single LED, it is understood that the device 1 may include several sources 6, for example a plurality of LEDs. For simplicity, the electric connections for supplying and operating the source 6 are neither shown nor described.

The collimator 7 is a total-internal-reflection catadioptric collimator, and in this case it comprises a cup-shaped body 14 which extends along axis A between an inlet end, provided with a recess 15 which accommodates the source 6, and an outlet end, optionally provided with a blind central cavity 16 aligned with the recess 15; the body 14 has, a generally convex, external side surface 17, defining an inner reflection surface inside the body 14 which conveys the light rays emitted by the source 6 into the body 14, parallelly to axis A to form the collimated beam existing from the body 14 through a front face 18 of the collimator.

The elements 11, 12 are aligned along axis A to the source 6 and are arranged facing each other and separated by a compartment 19; the element 11 is integrally mounted to the casing 5, whereas the element 12 is mounted to a head 20 which is movable with respect to the casing 5 by means of the mechanism 10.

Figure 3:
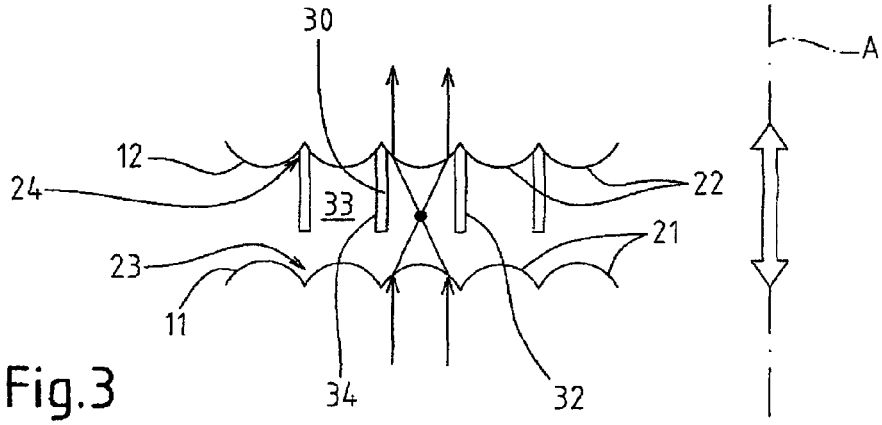
FIG. 3 diagrammatically shows a detail of the device in FIG. 1, with parts removed for clarity.
Figure 2:
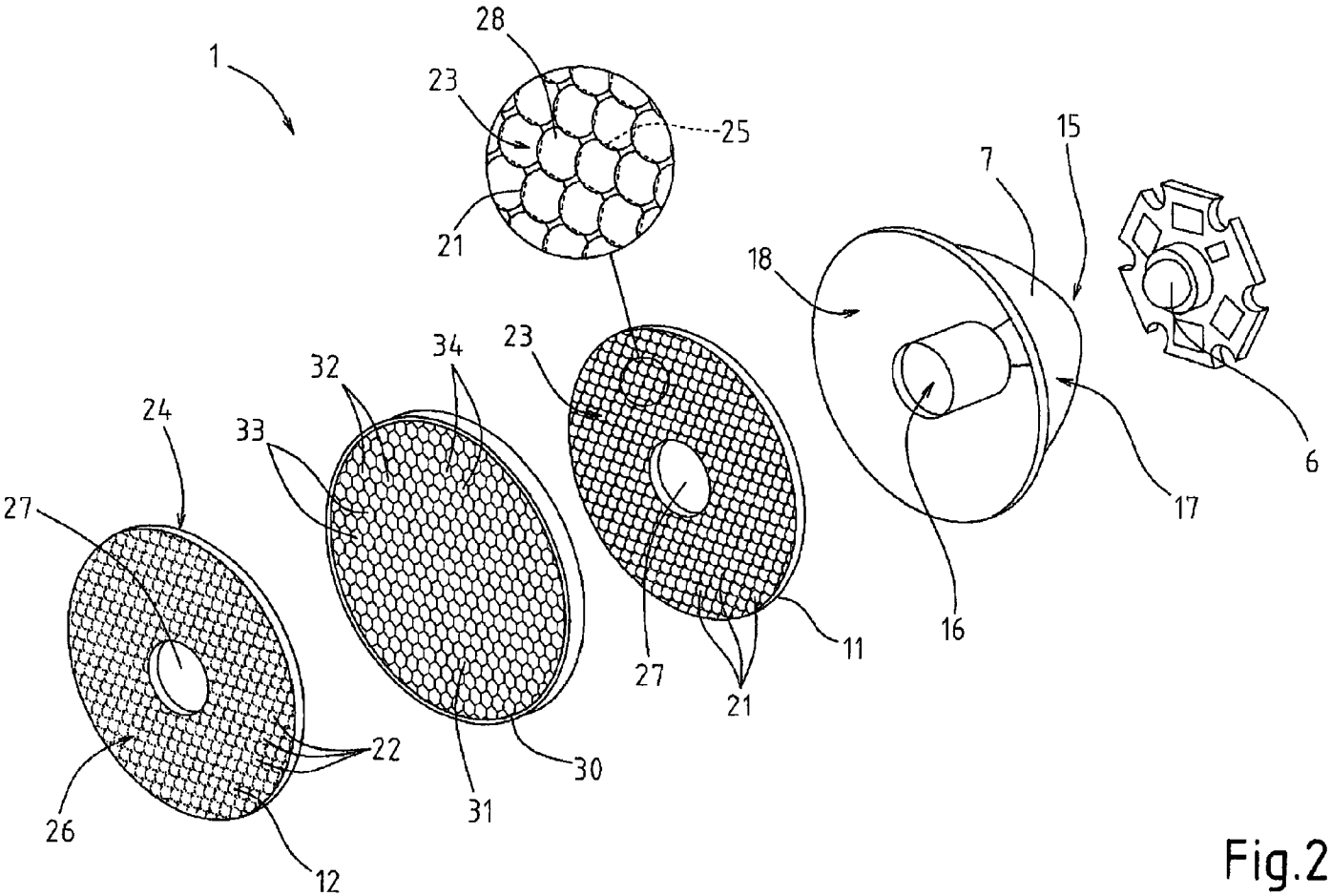
FIG. 2 is an exploded perspective view of some components of the device in FIG. 1, with a detail on enlarged scale.

With further reference to FIGS. 2 and 3, the elements 11, 12 carry respective arrays of lenses 21, 22 (so-called "micro-lenses", being significantly smaller in size than the total size of the optical element to which they belong) which protrude from respective faces 23, 24 of the elements 11, 12 facing each other and arranged according to a network pattern; each lens 21, is delimited on the face 23, 24 by a closed peripheral base edge 25, preferably polygonal (e.g. square or better hexagonal).

The lenses 21 of the element 11 face respective lens 22 of the element 12 and are shaped to converge respective portions of the collimated beam generated by the collimator 7; the lenses 22 are shaped to diverge the light from the lenses 21. Each lens 21 essentially sends the light only onto the lens 22 directly facing it.

Each lens 21 faces and is opposite to a lens 22 to form a pair of lenses 31, 32 aligned to each other parallel to axis A and having respective focuses also aligned parallelly to axis A and arranged between the optical elements 11, 12 in the compartment 19.

In particular, lenses 21 are arranged on the front face 18 of the collimator 7 and are integrally carried by the collimator 7; the lenses 21 are shaped so as to focus the collimated beam exiting from the front face of the collimator 7 into a plurality of focuses arranged between the elements in compartment 19. The lenses 22 are shaped so as to also have respective focuses in compartment 19 and to divert (and thus rectify) the beams emitted from both lens 21.

Element 12 has an outlet surface 26, axially opposite to the lenses 22 and, in this case, substantially smooth and flat.

If, as in the example shown, the collimator 7 has the central cavity 16, the elements 11, 12 have corresponding central through openings 27 aligned to each other and to cavity 16.

In the example shown in FIGS. 1-3, the facing lenses 21, 22 of each pair are substantially cup-shaped and have respective convex surfaces facing each other. It is understood that the lenses 21, 22 may also have different shapes, also according to the specific application provided for device 1; lenses 21 may also have a different shape from lenses 22.

The lenses 21, 22 of each element 11, 12 are arranged side-by-side in several directions; different arrangement patterns of the lenses 21, 22 may be used; the lenses 21, 22 of each element 11, 12 are preferably arranged with a hexagonal pattern (as shown in FIG. 2), but it is understood that other patterns are possible (e.g. square, with lenses arranged on rows and columns, etc.).

The lenses 21, 22 of each element 11, 12 are joined to one another along the respective edges 25 and project towards respective lenses of the other element substantially parallel to axis A.

For the purpose of reducing light intensity losses, the lenses 21, 22 of each element 11, 12 are preferably laterally in contact with one another, and adjacent lenses have adjacent lateral surface portions in common.

Being so side-by-side arranged, lenses 21, 22 have a polygonal base (e.g. hexagonal or square) on the faces 23, 24 of the elements 11, 12, and parts 28 protruding from the faces 23, 24 and having a round cross-section, e.g. substantially circular.

According to an important aspect of the invention, device 1 comprises a mask 30 arranged between the elements 11, 12 and shaped so as to laterally screen the light exiting from each lens 21 of element 11. The mask 30 is arranged close to the element 12 and is integrally carried by element 12, for example, and projects towards element 11.

The mask 30 is so shaped as to convey the light exiting from each lens 21 essentially only onto the lens facing such a lens 21 and to screen the adjacent lenses 21, 22.

In the illustrated embodiment, the mask 30 comprises a grid 31 substantially facing the elements 11, 12 and consisting of partitions 32 or plates intersecting and/or crossing each other for delimiting respective cells 33, reproducing the network pattern of the lenses 21, 22. The mask 30 thus has a plurality of cells 33 delimited by side walls 34 (consisting of portions of partitions 32); each cell 33 is aligned with a pair of facing lenses 21, 22 belonging to respective elements 11, 12 and is interposed between these lenses and delimited by side walls 34 aligned with the edges 25 of these lenses.

The walls 34 delimiting the cells 33 are substantially aligned with respective edges 25 of the lenses 21, 22 and extend substantially parallel to axis A or slightly inclined with respect to axis A.

The mask 30, made for example of opaque polymer or metal material, may be manufactured in different manners, e.g. it may be co-molded or over-molded or applied by insert-molding on one of the elements 11, 12, or may be separately made and mechanically coupled to one of the elements 11, 12 (e.g. by means of a peripheral edge thereof which engages a seat formed in one of the elements 11, 12), or in any other known manner, or may be ink or paint printed (e.g. by means of pad-printing or other suitable technique), directly onto one of the elements 11, 12.

In addition to one of the elements 11, 12, mask 30 may also be fixed to casing 5.

The mechanism 10 may be of any known type capable of axially moving (parallelly to axis A) the elements 11, 12 with respect to each other.

For example, mechanism 10 comprises a sliding coupling 38 between the casing 5, which carries the collimator 7 and the element 11, and the head 20, on which the element 12 is mounted by means of a support 39. The head 20 slides along axis A between two stroke-end positions, for example by means of shoes 40 inserted into guides 41 carried by casing 5. In this case, the element 12 is integrally fixed, both axially and angularly, to the head 20.

A different type of mechanism 10 may be obviously provided to move the two elements 11, 12 with respect to each other along axis A (without relative rotation), e.g. by means of a threaded and/or pivoting coupling between casing 5 and head 20, where the element 12 axially slides along axis A but is angularly blocked so that the element 12 only translates along axis A when the head 20 rotates about the axis A with respect to the casing 5.

The operation of device 1 is as follows.

The light emitted by the source 6 is collimated by the collimator 7 into a collimated beam of rays which are substantially parallel to axis A, which beam then passes through the element 11; lenses 21 converge the respective portions of the collimated beam, and lenses then diverge these beam portions to form the beam exiting from the device 1 through the surface 26.

The mask 30 ensures that each lens 21 of the element 11 sends light essentially only to the lens 22 of the element 12 which directly faces it, and screens the light which instead would go onto the other lenses 22 of the element 12.

Sliding the head 20 by means of the mechanism 10 with respect to the casing 5, and thus the elements 11, 12 with respect to each other, the distance along axis A between the elements 11, 12 is varied, and therefore the light beam exiting from the device 1 is adjusted.

Figure 4:
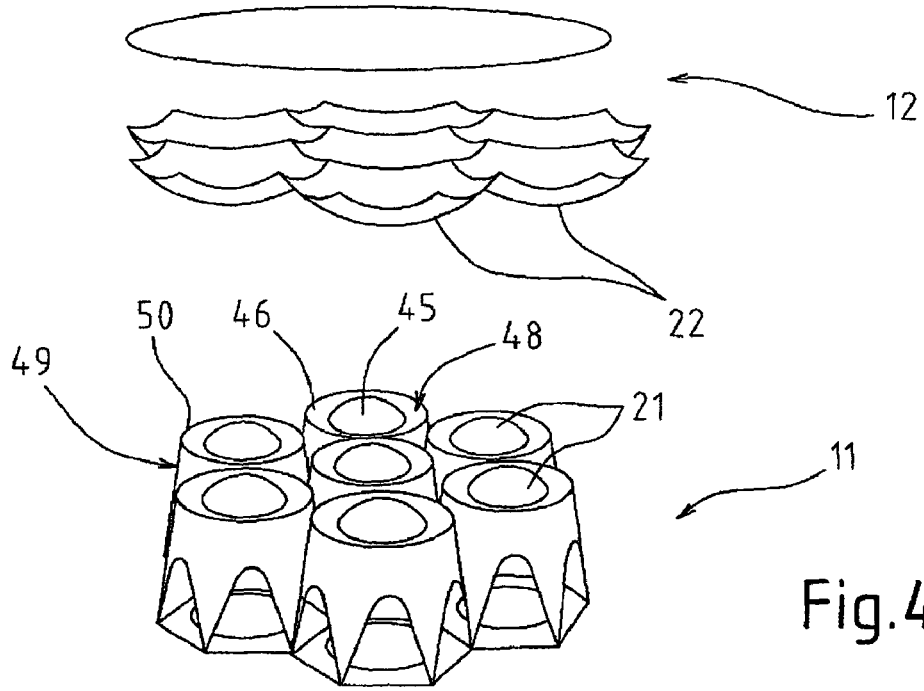
FIGS. 4 and 5 show some details of the device of the invention in accordance with a different embodiment.
Figure 5:
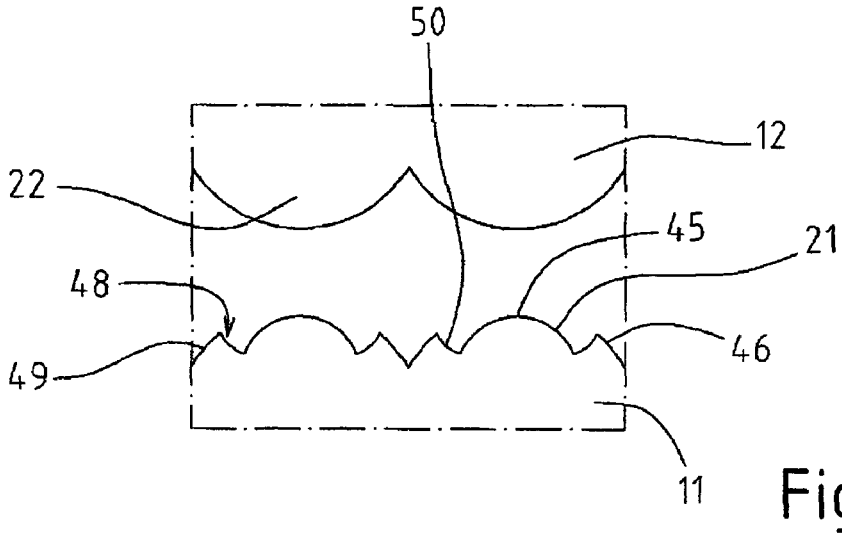

In the embodiment shown in FIGS. 4-5, at least one of the elements 11, 12, in particular the element 11 directly facing the collimator 7, comprises complex front surface lenses 21: each lens 21 comprises a central cup-shaped portion 45 having a convex outer surface, and an annular portion 46 arranged about the cup-shaped portion 45; the annular portion 46 has a substantially concave, radially inner side surface 48, facing the cup-shaped portion 45, and a substantially convex, radially outer side surface 49, opposite to the surface 48; the surfaces 48, 49 are joined in an annular cusp 50.

This particular conformation of the lenses 21 avoid the light beam emitted by the device 1 from reproducing the geometric shape of the bases of the lenses themselves (e.g. hexagonal), especially in the maximum opening configuration.

It is finally understood that further changes and variations may be made to the device described and shown herein without departing from the scope of the appended claims.

The invention claimed is:

1. A lighting device, comprising a first optical element having a first plurality of lenses adapted to receive light from a light source, a second optical element having a second plurality of lenses, each of said second plurality of lenses being positioned opposite to a respective one of said first plurality of lenses so as to form a lens pair such that the first lens of each pair directs light to a second lens of said pair, and a mask configured to receive light from at least one of the optical elements and shaped so as to laterally screen said received light, wherein at least one of said optical elements is movable with respect to the other optical element along an axis (A), and wherein said mask is carried by said at least one movable optical element.

2. The lighting device of claim 1, wherein the mask is configured to ensure that the light exiting the lighting device via a lens of any of said lens pairs is substantially the light conveyed to said lens via the other lens of the lens pair.

3. The lighting device of claim 1, further comprising a collimator disposed between said light source and said first optical element for collimating the light emitted by the source into a collimated beam.

4. The lighting device of claim 3, wherein said first plurality of lenses are arranged on a front face of the collimator.

5. The lighting device of claim 4, wherein said first plurality of lenses are integrally carried by the collimator.

6. The lighting device of claim 3, wherein said light source comprises a light emitting diode (LED).

7. The lighting device of claim 1, wherein said mask is disposed between said first and second optical elements.

8. The lighting device of claim 7, wherein said mask is configured to laterally screen light exiting from each lens of the first optical element so as to convey the light exiting from each lens of the first optical element substantially only to an opposed lens of the second optical element.

9. The lighting device of claim 1, wherein said mask comprises a grid providing a plurality of cells each of which is aligned with one of the lenses of the optical element to which the mask is coupled.

10. The lighting device of claim 9, wherein said grid comprises a plurality of intersecting partitions providing side walls for delimiting said cells.

11. The lighting device of claim 10, wherein said side walls are substantially aligned with respective edges of said first and second plurality of lenses.

12. The lighting device of claim 10, wherein said lighting device substantially extends along an axis (A), and said side walls extend substantially parallel to said axis (A).

13. The lighting device of claim 10, wherein said lighting device substantially extends along an axis (A), and said side walls are inclined with respect to said axis (A).

14. The lighting device of claim 9, wherein said first and second plurality of lenses comprise an array of lenses arranged according to a network pattern, and wherein said cells of the grid provide a network pattern corresponding to said pattern of said lens arrays.

15. The lighting device of claim 1, wherein said mask is formed of any of an opaque polymer or metal.

16. The lighting device of claim 1, further comprising a movement mechanism for moving the first and the second optical elements with respect to each other along the axis (A).

17. The lighting device of claim 16, further comprising a casing to which one of said optical elements is mounted and a head to which the other optical element is mounted, wherein said head is movable with respect to the casing.

18. The lighting device of claim 1, wherein said first and second optical elements are arranged to be separated from one another by a compartment, and wherein said plurality of lenses of said first and second optical elements are configured such that their respective foci lie in said compartment.

19. The lighting device of claim 1, wherein the lenses of each of said pairs have convex surfaces facing each other.

* * * * *